US007905489B2

(12) United States Patent
Cornfield

(10) Patent No.: US 7,905,489 B2
(45) Date of Patent: Mar. 15, 2011

(54) PORTABLE GAMING SYSTEM AND RELATED METHODS

(76) Inventor: James R. Cornfield, Oak Lawn, IL (US)

( * ) Notice: Subject to any disclaimer, the term of this patent is extended or adjusted under 35 U.S.C. 154(b) by 577 days.

(21) Appl. No.: 11/890,088

(22) Filed: Aug. 3, 2007

(65) Prior Publication Data

US 2008/0029963 A1 Feb. 7, 2008

Related U.S. Application Data

(60) Provisional application No. 60/835,196, filed on Aug. 3, 2006.

(51) Int. Cl.
*A63B 67/00* (2006.01)
*A63B 67/06* (2006.01)

(52) U.S. Cl. ..... 273/336; 273/317

(58) Field of Classification Search ..... 273/336, 273/338, 317; D21/304
See application file for complete search history.

(56) References Cited

U.S. PATENT DOCUMENTS

| | | | | | |
|---|---|---|---|---|---|
| D33,152 | S | * | 9/1900 | Hawkins | D21/304 |
| 915,450 | A | * | 3/1909 | Levey | 273/336 |
| 1,098,872 | A | | 6/1914 | Akerberg | |
| 1,178,049 | A | | 4/1916 | Beardsley | |
| 1,513,968 | A | | 11/1924 | Crandall | |
| 1,541,897 | A | | 6/1925 | Buedingen | |
| 1,543,767 | A | | 6/1925 | Heggen | |
| 2,007,885 | A | * | 7/1935 | Spriggs | 124/16 |
| 2,230,294 | A | | 2/1941 | Heggie | |
| 2,265,517 | A | * | 12/1941 | Clement | 273/336 |
| 2,468,428 | A | | 4/1949 | Decker | |
| 2,476,532 | A | | 7/1949 | Bouchard | |
| D195,631 | S | * | 7/1963 | Klingaman | D21/304 |
| 3,356,368 | A | | 12/1967 | Dixon | |
| D218,764 | S | * | 9/1970 | Abraham | D21/304 |
| 3,547,442 | A | | 12/1970 | Fenicchia | |
| 3,778,061 | A | | 12/1973 | Sargent | |
| 3,844,560 | A | | 10/1974 | Litsch | |
| 3,953,031 | A | | 4/1976 | Kinser | |
| 4,012,042 | A | * | 3/1977 | Blasingame | 273/401 |
| 4,130,281 | A | | 12/1978 | Leber | |
| 4,203,592 | A | | 5/1980 | Quatkemeyer | |
| 4,273,340 | A | | 6/1981 | Hackett | |
| 4,314,702 | A | | 2/1982 | Updike | |
| D266,678 | S | | 10/1982 | Herrmann | |
| 4,789,163 | A | | 12/1988 | Warner | |
| 4,927,159 | A | | 5/1990 | Morrissey | |
| 4,952,073 | A | | 8/1990 | Wieland | |
| 4,964,644 | A | | 10/1990 | Hull | |
| 4,968,041 | A | * | 11/1990 | Calvo | 273/401 |
| 4,982,966 | A | * | 1/1991 | Teafatiller | 273/338 |
| 4,989,880 | A | * | 2/1991 | Gettemeier et al. | 273/336 |
| 5,317,489 | A | | 5/1994 | Delli Gatti | |
| D378,687 | S | * | 4/1997 | Clark et al. | D21/304 |
| D388,127 | S | * | 12/1997 | Cavallone, Sr. | D21/304 |
| 5,863,045 | A | * | 1/1999 | Watson et al. | 273/336 |
| 5,971,396 | A | | 10/1999 | Wieland | |
| 2005/0189717 | A1 | | 9/2005 | Wieland | |
| 2006/0022409 | A1 | * | 2/2006 | Zimmermann | 273/400 |
| 2008/0029963 | A1 | * | 2/2008 | Cornfield | 273/336 |

* cited by examiner

*Primary Examiner* — Raleigh W. Chiu
(74) *Attorney, Agent, or Firm* — Valauskas Corder LLC

(57) ABSTRACT

The present invention generally relates to a system and methods for facilitating entertainment. More specifically, the present invention is directed to a system, certain embodiments of which include easy to transport and to assemble components and, when assembled, provide a portable apparatus which a human can engage in horseshoe gaming. The system includes an apparatus which, in one embodiment, includes a frame element, a vertical element and a cushion element.

16 Claims, 3 Drawing Sheets

PORTABLE GAMING SYSTEM AND RELATED METHODS

This application claims the benefit of U.S. Provisional Application No. 60/835,196 filed Aug. 3, 2006.

FIELD OF THE INVENTION

The present invention generally relates to a system and methods for facilitating entertainment. More specifically, the present invention is directed to a system, certain embodiments of which include easy to transport and to assemble components and, when assembled, provide a portable apparatus which a human can engage in horseshoe gaming.

BACKGROUND OF THE INVENTION

Horseshoes is an outdoor game played between two people (or two teams of two people) using four horseshoes and two stakes. The game is played by the players alternating turns tossing horseshoes at stakes in the ground that are positioned at a pre-determined distance apart, traditionally 40 feet apart. Modern games use a more stylized U-shaped bar, about twice the size of an actual horseshoe.

In some installations, U-shaped boxes or frames extend around the stake forming a pit, or court. In some installations, clay or sand surround the stake to prevent holes or divots in the area around the stakes.

The National Horseshoe Pitchers Association of America (NHPA) is the recognized governing body of the official sport of horseshoe pitching and maintains an up-to-date set of rules, which include guidelines and specifications for the game. The NHPA rules are widely accepted as being the official way to play the game, although it should be recognized that the NHPA rules are not always followed and are sometimes modified, as well as players making their own rules known as "house rules".

According to the NHPA, specifications for a horseshoe game include positioning stakes 40 feet apart. The stakes, one inch (1") in diameter, are placed such that fourteen inches (14") remain above the floor and are positioned at an angle of about twelve degrees (12°) so each leans toward the opposite stake. The maximum pit dimensions are thirty six inches (36") by seventy two inches (72"), although the pit dimensions may be reduced to as little as thirty one inches (31") by forty three inches (43"), most likely to minimize the amount of pit fill material to maintain. Pit fill material typically includes clay or sand.

The horseshoe weight is typically not more than two pounds, ten ounces and cannot exceed seven and one-quarter inches (7¼") in width or seven and five-eighths inches (7⅝") in length. The opening of the shoe must not exceed three and one-half inches (3½").

There are portable horseshoe pits, such as U.S. Pat. No. 4,314,702 that have an attachable stake, and some provide artificial surfaces such as rubber while others, such as U.S. Pat. No. 4,273,340, have provided flexible support springs, while others, such as U.S. Pat. No. 3,547,442 provide a mat centered between side walls and a stake projecting through the center of the mat with the lower end of the stake being fastened to a support, which lies beneath the mat.

While the prior art inventions have proved somewhat satisfactory, there are disadvantages that are overcome by the present invention, such as quickly and easily assembling the system, and a compact configuration when not in use for ease of traveling.

A demand therefore exists for a system and methods, embodiments of the apparatus of which are formed from lightweight, easy to transport components that can be quickly joined together without the need for tools and, when fully assembled, provide a stable system for play of a game of horseshoes. The present invention satisfies the demand.

SUMMARY OF THE INVENTION

The present invention is directed to a portable gaming system and methods, certain embodiments of which may be easily assembled from lightweight and easy to transport components and, when assembled, provides a stable system for play of a game of horseshoes. It is also contemplated the present invention is applicable to similar horseshoe-type games, such as quoits. Quoits involves the throwing of a metal or rubber ring over a set distance to land over a pin in the centre of a patch of clay.

For purposes of this application, the person using the portable gaming system will be termed "player" herein. Also, for purposes of this application, the surface on which the portable gaming system is placed will be termed "floor" even though the system can be used and the methods conducted in a wide variety of interior spaces—including buildings—and exterior spaces—including a lawn area or a garden area, a playground, a patio, driveway, or other hard surfaces—and even in and on non-fixed structures—such as a boat and on its deck or other area of the vessel.

The system of the present invention is directed to an apparatus that includes a frame element, a vertical element and a cushion element. Certain preferred embodiments of the frame element include a first side component, a second side component and a rear side component that can further be joinable by connecting components. The frame element is erected, or assembled, to form a U-shaped configuration defining an interior space and an exterior space. It is also contemplated the frame element further includes a front side component to form a square or rectangular shaped configuration. The side components are about four feet (4') feet long, but any length is contemplated. Likewise, any width and height of the side components are contemplated.

According to the present invention, the horseshoe gaming system includes two frame elements, although is contemplated that the court of the present invention comprises one frame element for solitary play.

The side components of the frame element can be constructed from a lightweight material that is durable to withstand impact from an incoming horseshoe without damaging the components of the system. For example, the frame element can be constructed from wood, rubber, plastic or polymers such as polychloroethene (PVC), polyethylene, or polypropylene, and even lightweight iron or steel, either painted, brushed, coated, or stainless.

The connecting components to unify the side components may be releasable or fixed. Fixed connecting components, such as a hinge, allow the side components to be maneuverable, such as foldable, from a collapsed state to an erected state. Releasable connecting components, such as a tongue and groove connection, snap-fit engagement, pressure fit attachment, pin or screw, magnets, zippers, tie-down straps, Velcro®, buttons, and even reusable double-sided adhesive allow the side components to be assembled into an erected state. Once assembled, the frame element maintains a U-shaped configuration with no give or play in any direction.

Other embodiments of the side components include attachment components. The side components include inside faces and outside faces and the attachment components are positioned on the inside faces of the side components for releasable attachment to the cushion element. The attachment components can be placed on the side components, for example by insert molding, adhesive, heat welding, or snap-fit engagement.

Certain preferred embodiments of the frame element include a stabilizing component positioned on the bottom face of the side components. The stabilizing component, such as suction or vacuum cups, spikes, tacks, claws, or rubber feet secures the frame element to the floor, even in wet conditions. It is further contemplated the stabilizing component can be maneuverable, such as foldable, from a collapsed state to an erected state. For example, the stabilizing component can be positioned in a recessed portion in the collapsed state, such that the player "pops" the stabilizing component to erect it from the recessed portion by using a finger. Once assembled, the frame element is stable such that there is no give or play in any direction and the frame element maintains a U-shaped configuration.

Certain preferred embodiments of the vertical element include a stake component that can simply be inserted into the floor. Other preferred embodiments of the vertical element include a stake component and a base component that is hingedly connected such that stake component can be maneuverable, such as foldable, from a collapsed state to an erected state. For example, the stake component can be positioned in a recessed portion located on the base component, such that the player "pops" the stake component to erect it from the recessed portion by using a finger.

In one preferred embodiment, the vertical element includes a base component with a reception component such that the stake component is releasably received, such as in slidable engagement or screwable engagement, with the reception component providing stable support therefore. One embodiment of the reception component is a flush reception aperture generally not raised above the top surface of the base component and is sized and shaped to receive a portion of the stake component. Another embodiment of the reception component includes a raised reception aperture extending above the top surface of the base component in or on which the stake component may be received.

The vertical element can be constructed from a lightweight material that is durable to withstand impact from a horseshoe without damaging the components of the system. For example, the frame element can be constructed from wood, rubber, plastic or polymers such as polychloroethene (PVC), polyethylene, or polypropylene, and even lightweight iron or steel, either painted, brushed, coated, or stainless.

The vertical element is positioned within said interior space of the U-shaped configuration of an erected, or assembled, frame element. The stake component of the vertical element can be angled, such as twelve degrees (12°) toward the opposite frame element.

Other embodiments of the vertical element include an anchoring component on the bottom surface of the base component. The anchoring component, such as suction or vacuum cups, spikes, tacks, claws, or rubber feet, secures the vertical element to the floor, even in wet conditions. Once assembled, the vertical element is stable such that there is no give or play in any direction and withstands impact from an incoming horseshoe.

The cushion element simulates pit fill material, for example clay or sand, and absorbs shock of an incoming horseshoe. Certain preferred embodiments of the cushion element are a uniform piece of material, such as memory foam. Other preferred embodiments of the cushion element include a casing component and a fill component. The casing component can be made of any durable material such as nylon, tyvex, rubber, polyester or burlap. The fill component can be, for example, dirt, sand, clay, mineral combination, polyurethane combination or memory foam, and is positioned within the casing component.

It is contemplated the fill component is of any configuration, such as a unitary piece or a plurality of pieces, for example, strips, pellets, diced or cubed pieces.

It is further contemplated the cushion element includes a plurality of individual pockets such that the fill component does not fall into a large mound at the bottom of the casing component when picked up for transport. Individual pockets further allows for compactness, i.e., rolled for easy transport. Upon positioning the fill component within the casing component, the casing component is sealed to confine the fill component. The filled casing component can be sealed in any variety of methods, for example, sewn, heat welded, zipper, snaps, buttons, or Velcro®.

Other embodiments of the cushion element include a securing component positioned on a perimeter edge. The securing component can be placed on the perimeter edge, for example by sewing, adhesive, heat welding, or snap-fit engagement.

The securing component releasable connects to the attachment component on the inside faces of the frame element to stabilize the cushion element and prevent it from shifting during play of the game. The securing component of the cushion element and the attachment component of the frame element releasable connect, such that the securing component and attachment component can be in a male-female configuration such as a tongue and groove connection, snap-fit engagement, pressure fit attachment, hook and ring, buttons, magnets, zippers, Velcro® and even reusable double-sided adhesive.

Other embodiments of the cushion element further include a receiving aperture to account for the vertical element such that the vertical element protrudes outside the cushion element. The receiving aperture can be any configuration, such as a hole or a slit that extends toward the center of the cushion element from the perimeter edge. In one embodiment, the receiving aperture is located about the center of the cushion element.

The cushion element can be of any thickness or configuration and it is further contemplated a plurality of cushion elements can be used, either by stacking them upon one another or releasable connecting one to each side component, and even joining the plurality of cushion elements to each other.

It is further contemplated the present invention includes a pitching platform component. The pitching platform component is positioned next to the frame element and provides a stable surface from which a player throws the horseshoe.

The present invention contemplates the use of standard steel horseshoes, but in different situations, for example tailgating or when children are present, a safer alternative can be used, such as a solid rubber horseshoe or rubber coated horseshoe.

It is preferred that the materials from which the system elements and components are made are relatively easy to clean after use and resistant to rusting even when used in outdoor locations.

One advantage of the present invention is that the system may be assembled from components that are lightweight, compact, and sized and shaped such that they are easy to package and easy to transport.

Another advantage of the present invention is that components are sized and shaped and structured so that one person can join them to form desired configurations of the system without the need for tools.

An added advantage of the present invention is that the system can be easily disassembled and stored in a relatively small space when not in use. The present invention could further include a case for carrying all the disassembled components.

Yet another advantage of the present invention is that the system, when in use, equates to a game played on a permanently erected court.

Another advantage of the present invention is that the system is inexpensive to manufacture.

Yet another advantage of the present invention is to provide an improved portable horseshoe game that is compact and can quickly be erected or collapsed for transportation.

Another advantage of the present in invention is to prevent damage to the floor, or surface on which the portable gaming system is placed.

It will of course be understood that the aspects and objectives of the invention are various, and need not be all present in any given embodiment of the invention. The features, advantages and accomplishments of the invention will be further appreciated and understood upon consideration of the following detailed description of an embodiment of the invention, taken in conjunction with the drawings, which follow.

BRIEF DESCRIPTION OF THE DRAWINGS

The preferred embodiments of the invention will be described in conjunction with the appended drawings provided to illustrate and not to limit the invention, where like designations denote like elements, and in which.

DETAILED DESCRIPTION OF EMBODIMENTS OF THE INVENTION

The present invention is directed to a portable gaming system and methods, certain embodiments of which may be easily assembled from lightweight and easy to transport components and, when assembled, provides a stable system for play of a game of horseshoes. It is also contemplated the present invention is applicable to similar horseshoe-type games, such as quoits.

Figure 1:
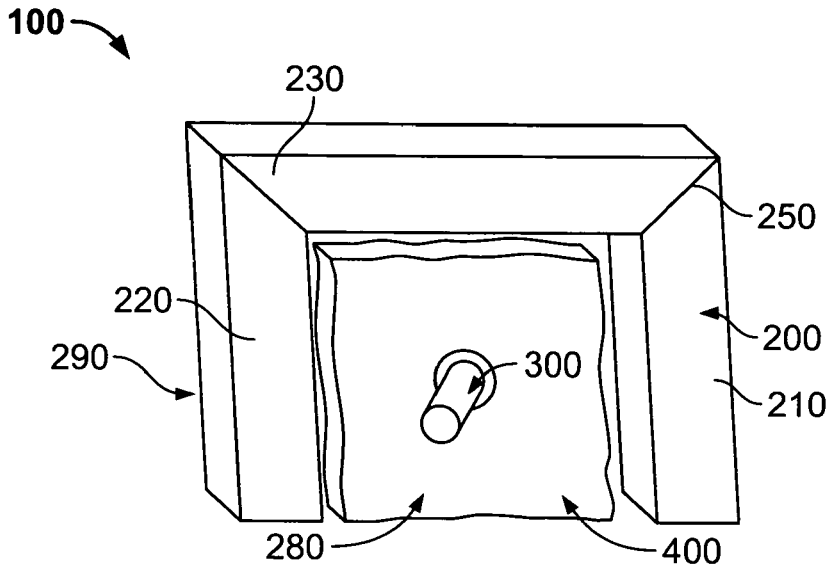
FIG. 1 is a perspective view of an embodiment of an assembled portable gaming system according to the present invention.

As illustrated in FIG. 1, the present invention is directed to a system 100 that includes a frame element 200, a vertical element 300 and a cushion element 400. Certain preferred embodiments of the frame element 200 include a first side component 210, a second side component 220 and a rear side component 230 that can further be joinable by connecting components 250. The frame element 200 is erected, or assembled, to form a U-shaped configuration as shown in FIG. 1 defining an interior space 280 and an exterior space 290. The side components 210, 220, 230 can be assembled at approximately ninety degrees (90°) with respect to one another, although the present invention contemplates any angle.

Figure 2:
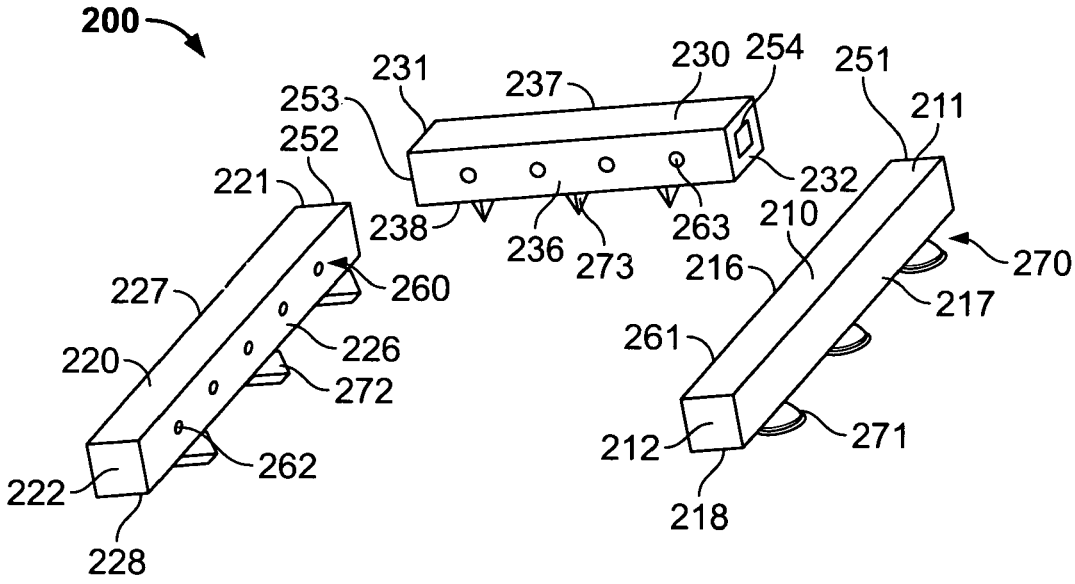
FIG. 2 is a perspective view of one embodiment of a frame element according to the present invention.

The side components 210, 220, 230 of the frame element 200 can be constructed from a lightweight material that durable to withstand impact from an incoming horseshoe without damaging the components of the system. As shown in FIG. 2, the first side component 210 includes a first side end 211 and a second side end 212. A first connecting component 251 is positioned on one of said side ends 211, 212; here first side end 211. The first side component 210 further includes an inside face 216 and an outside face 217.

Certain embodiments include an attachment component 260 positioned on the frame element 200. Attachment component 260 allows the releasable attachment to the cushion element 400. Certain other embodiments also include a stabilizing component 270. Stabilizing component 270 allows the releasable securement of the frame element 200 to the floor.

The first side component 210 includes an attachment component 260, here a snap button 261, positioned on the inside face 216. The first side component 210 further includes a first bottom face 218 with a first stabilizing component 271, here a vacuum cup, positioned thereon.

The second side component 220 includes a first side end 221 and a second side end 222. A second connecting component 252 is positioned on one of said side ends 221, 222; as shown in FIG. 2, the first side end 221. The second side component 220 further includes an inside face 226 and an outside face 227. As shown, attachment component 262 positioned on the inside face 226 of the second side component 220 allows the releasable attachment to the cushion element 400. The second side component 220 also includes a second bottom face 228 with a second stabilizing component 272 positioned thereon.

The rear side component 230 includes a first rear side end 231 and a second rear side end 232. A third connecting component 253 is positioned on the first rear side end 231 and a forth connecting component 254 is positioned on the second rear side end 232. The rear side component 230 further includes an inside face 236 and an outside face 237 with an attachment component 263 positioned on the inside face 236 for releasable attachment to the cushion element 400. The second side component 230 further includes a rear bottom face 238 with a rear stabilizing component 273 positioned thereon for releasable securement of the frame element 200 to the floor.

Figure 3:
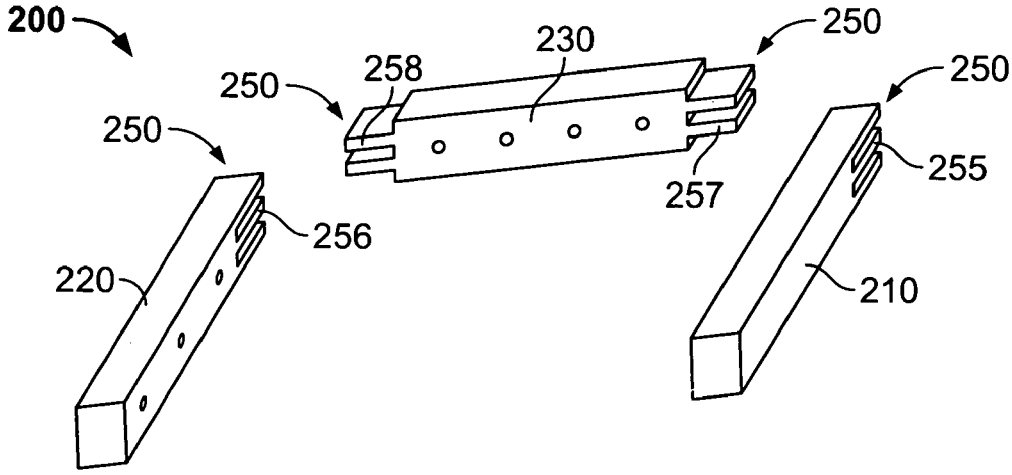
FIG. 3 is a perspective view of an alternate embodiment of a frame element according to the present invention.

The connecting components 250 unify the side components 210, 220, 230. For illustrative purposes, FIG. 3 shows connecting components 250 in a snap-fit engagement with female receptacles 255, 256 and male protrusions 257, 258. Although, it is contemplated that the connection components may be fixed, such as a hinge, to allow the side components to be maneuverable such as by unfolding the side components folded upon one another from a collapsed state to an erected state. As shown in FIG. 3, female receptacle 255 of the first side component 210 releasable engages with the male protrusion 257 of the rear side component 230. Likewise the female receptacle 256 of the second side component 220 releaseably engages with the male protrusion 258 of the rear side component 230. Once assembled, the frame element 200 maintains a stable and secure U-shaped configuration.

Figure 4:
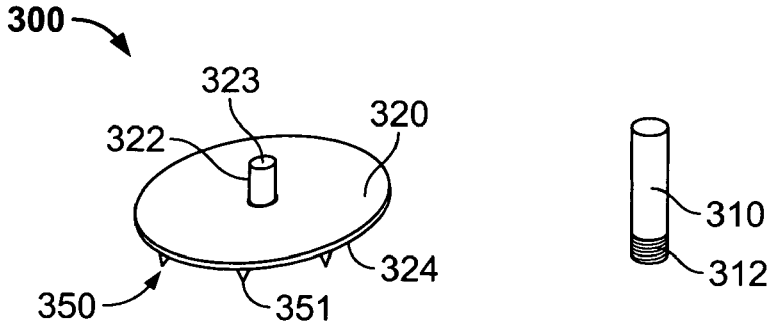
FIG. 4 illustrates a perspective view of one embodiment of a vertical element according to the present invention.

FIG. 4 illustrates a perspective view of one embodiment of the vertical element 300 according to the present invention.

The vertical element 300 includes a stake component 310 and a base component 320. It is contemplated that when playing on a soft surface, such as grass or dirt, the stake component 310 can be simply inserted in the soft surface, otherwise, a vertical element 300 with a base component 320 can be used.

As shown in FIG. 4, one preferred embodiment of the vertical element 300 includes a base component 320 with a reception component 322, here a threaded raised reception aperture 323. The stake component 310 includes a portion of threads 312 for screwable engagement within the reception component 322. It is contemplated that the reception component 322 can be angled, such as twelve degrees (12°) toward the opposite frame element.

Figure 5:
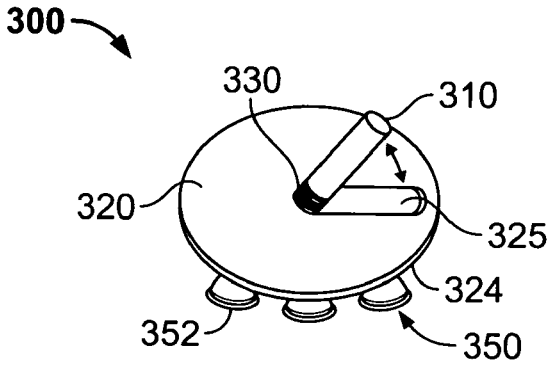
FIG. 5 illustrates a perspective view of another embodiment of a vertical element according to the present invention.

Another embodiment of the vertical element 300 is shown in FIG. 5 and includes a stake component 310 and a base component 320 connected by a hinge 330 such that stake component 310 can be maneuverable, such as foldable, from a collapsed state to an erected state. For example, the stake component 310 can be positioned in a recessed portion 325 located in base component 320, such that the player "pops" the stake component to erect it from the recessed portion 325 by using a finger. It is contemplated that the hinge 330 allows the stake component 310 to be erected into place at a desired angle toward the opposite frame element 200.

Other embodiments of the vertical element 300 include an anchoring component 350 on the bottom surface 324 of the base component 320. The anchoring component 350, shown as spikes 351 in FIG. 4 and vacuum cups 352 in FIG. 5, secures the vertical element 300 to the floor, even in wet conditions.

The vertical element 300 is positioned within the interior space 280 of the U-shaped configuration of an erected, or assembled, frame element 200. The vertical element 300 is sized and shaped to be positioned under the cushion element 400.

Figure 6:
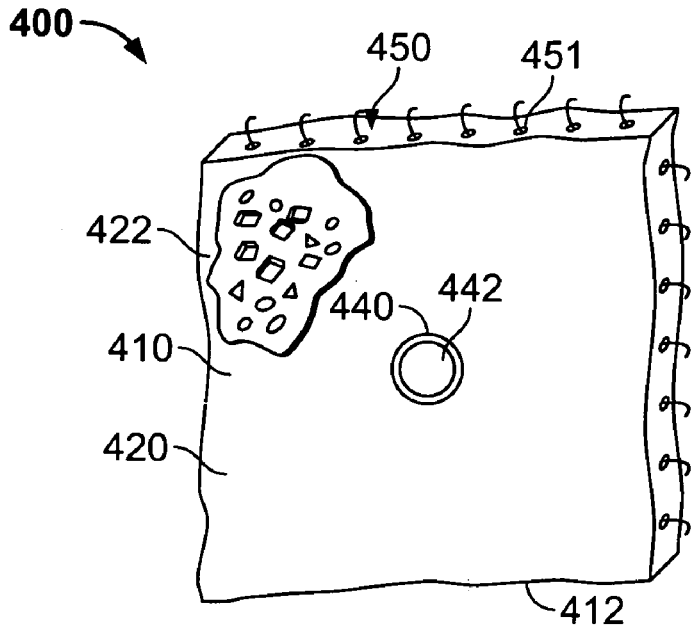
FIG. 6 is a perspective view of an embodiment of a cushion element according to the present invention.

As shown in FIG. 6, an embodiment of the cushion element 400 includes a casing component 410 and a fill component 420, although it is contemplated that cushion element 400 only has a fill component 420 that is a uniform piece of material, such as memory foam. The fill component 420 is positioned within the casing component 410. Here, the fill component 420 is a plurality of memory foam pieces 422. The cushion element 400 further includes a receiving aperture 440, here a punched hole 442, such that the vertical element 300 protrudes through the cushion element 400. It is also completed the receiving aperture 440 can be a slit 444 that extends toward the center of the cushion element 400 from a perimeter edge 412, as shown in FIG. 7.

Figure 7:
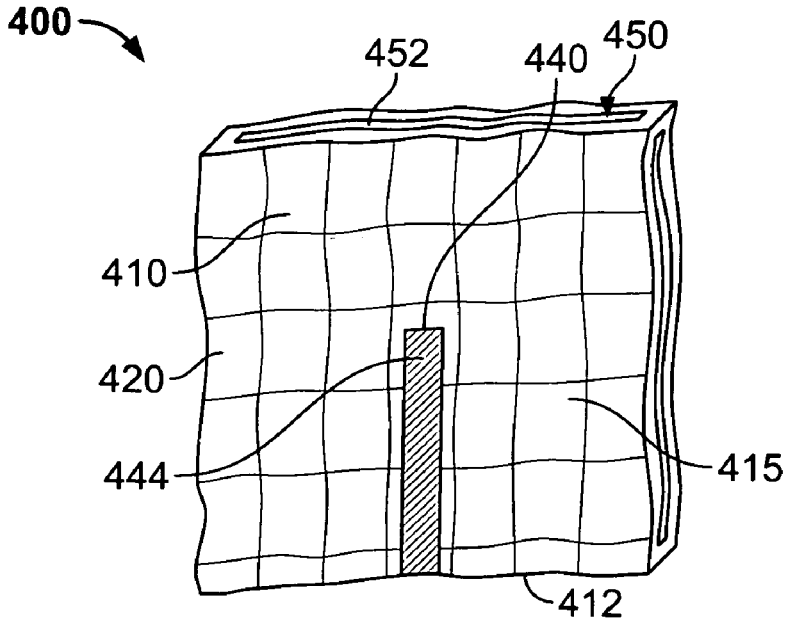
FIG. 7 illustrates a perspective view of another embodiment of a cushion element according to the present invention.

Further shown in FIG. 7, the cushion element 400 includes a plurality of individual pockets 415 such that the fill component 420 does not fall into a large mound at the bottom of the casing component 410 when picked up for transport. The individual pockets 415 further allow for compactness, i.e., rolled for easy transport. The cushion element 400 may further include a securing component 450 positioned on a perimeter edge 412. The securing component 450 releasable connects to the attachment components 260 of the frame element 200 to stabilize the cushion element 400 and prevent it from shifting during play of the game. The securing components 450 are hooks 451, as shown in FIG. 6, that releasable attach to rings, for example, of the frame element 200. FIG. 7 illustrates the securing components 450 as Velcro® 452, joinable to attachment components 260, likewise constructed of Velcro®.

While the present invention has been described with reference to particular embodiments, those skilled in the art will recognize that many changes may be made thereto without departing from the scope of the present invention. For example, two pieces can be used to create the frame, only one of the back piece or side pieces includes a groove, only one filled bag is used, a frame construction that does not require pins, to name a few. Each of these embodiments and variants thereof is contemplated as falling with the scope of the claimed invention, as set forth in the following claims.

I claim:

1. A gaming apparatus, said apparatus comprising:

a frame element, wherein said frame element includes, a first side component including a first side end and a second side end, wherein a first connecting component is positioned on one of said side ends;

a second side component including a third side end and a fourth side end, wherein a second connecting component is positioned on one of said side ends;

a rear side component including a first rear side end and a second rear side end, wherein a third connecting component and a fourth connecting component are positioned on one of each of said rear side ends;

said first connecting component and said second connecting component each joinable to one of said third connecting component and said fourth connecting component to form a U-shaped configuration defining an interior space;

a vertical element including a stake component, wherein said vertical element is positioned within said interior space;

a cushion element including a receiving aperture, wherein said cushion element comprises a casing component and a fill component and is positioned within said interior space such that said receiving aperture receives said vertical element.

2. The gaming apparatus of claim 1, wherein said first side component further comprises a first side inside face and a first side outside face, wherein a first attachment component is positioned on said first side inside face.

3. The gaming apparatus of claim 2, wherein said cushion element further comprises a securing component positioned on a perimeter edge.

4. The gaming apparatus of claim 3 wherein said securing component releasably attaches to said first attachment component.

5. The gaming apparatus of claim 1, wherein said first side component further comprises a first bottom face, wherein a first stabilizing component is positioned on said first bottom face.

6. The gaming apparatus of claim 1, wherein said second side component further comprises a second side inside face and a second side outside face, wherein a second attachment component is positioned on said second side inside face.

7. The gaming apparatus of claim 6, wherein said cushion element further comprises a securing component positioned on a perimeter edge.

8. The gaming apparatus of claim 7, wherein said securing component releasably attaches to said second attachment component.

9. The gaming apparatus of claim 1, wherein said second side component further comprises a second bottom face, wherein a second stabilizing component is positioned on said second bottom face.

10. The gaming apparatus of claim 1, wherein said rear side component further comprises a rear side inside face and a rear side outside face, wherein a third attachment component is positioned on said rear side inside face.

11. The gaming apparatus of claim 10, wherein said cushion element further comprises a securing component positioned on a perimeter edge.

12. The gaming apparatus of claim 11, wherein said securing component releasably attaches to said third attachment component.

13. The gaming apparatus of claim 1, wherein said rear side component further comprises a rear bottom face, wherein a rear stabilizing component is positioned on said rear bottom face.

14. The gaming apparatus of claim 1, wherein said vertical element further comprises a base component including a bottom surface and a top surface, wherein said top surface includes a reception aperture for engagement with said stake component.

15. The gaming apparatus of claim 14, wherein said bottom surface of said base component further comprises an anchoring component.

16. The gaming apparatus of claim 1, wherein said fill component is memory foam.

* * * * *